United States Patent [19]

Rotermund et al.

[11] Patent Number: 4,676,469

[45] Date of Patent: Jun. 30, 1987

[54] COMPOSITE BAR SECTION

[75] Inventors: Hermann Rotermund, Karlsruhe; Herbert L. Wiesmann, Hameln; Arno Leiendecker, Tauberbischofsheim, all of Fed. Rep. of Germany

[73] Assignee: VS Vereinigte Spezialmoebelfabriken Verwaltungs GmbH, Fed. Rep. of Germany

[21] Appl. No.: 777,672

[22] Filed: Sep. 19, 1985

[30] Foreign Application Priority Data

Oct. 5, 1984 [DE] Fed. Rep. of Germany ..... 3436492

[51] Int. Cl.[4] ..... E04G 3/08

[52] U.S. Cl. ..... 248/243; 52/729; 52/730; 248/246

[58] Field of Search ..... 248/243, 244, 245, 246, 248/241, 188.1, 274, 228; 52/36, 729, 730

[56] References Cited

U.S. PATENT DOCUMENTS

| | | | |
|---|---|---|---|
| 919,526 | 4/1909 | Belcher | 248/243 X |
| 2,336,604 | 12/1943 | Edward et al. | 248/243 |
| 3,261,585 | 7/1966 | Constantini et al. | 248/243 |
| 3,489,291 | 1/1970 | Frazier | 248/245 X |
| 3,712,015 | 1/1973 | Nelson | 52/36 X |
| 3,735,548 | 5/1973 | Ferrari et al. | 52/36 |
| 4,189,459 | 2/1980 | Jones | 52/36 X |
| 4,566,231 | 1/1986 | Konsevich | 52/729 X |

FOREIGN PATENT DOCUMENTS

| | | | |
|---|---|---|---|
| 6948521 | 12/1969 | Fed. Rep. of Germany . | |
| 7120338 | 9/1971 | Fed. Rep. of Germany . | |
| 2256705 | 5/1973 | Fed. Rep. of Germany . | |
| 2551564 | 5/1977 | Fed. Rep. of Germany . | |
| 7808705 | 9/1978 | Fed. Rep. of Germany . | |
| 2901337 | 3/1980 | Fed. Rep. of Germany . | |
| 8201879 | 5/1982 | Fed. Rep. of Germany . | |
| 0036324 | 7/1967 | Finland | 248/243 |

*Primary Examiner*—Ramon O. Ramirez

*Attorney, Agent, or Firm*—Steele, Gould & Fried

[57] ABSTRACT

A composite bar section for furniture and interior fittings is formed by two or more section bars and connecting elements, the connecting elements being inserted between two adjacent section bars, shaped and so undetachably interconnected, that on two opposite sides of the composite bar longitudinal slots are formed for housing randomly positionable connecting members of further components. As a function of the requirements, while using the same section bars, varyingly wide connecting elements can be used and consequently the cross-sectional shape of the sections can be varied.

34 Claims, 31 Drawing Figures

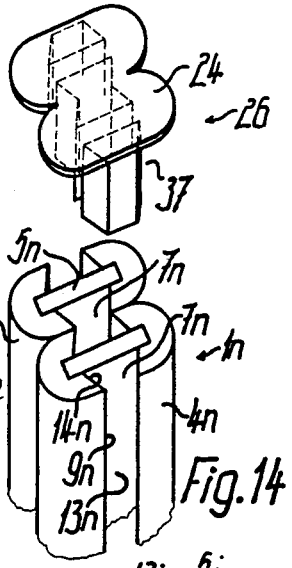
Fig.14
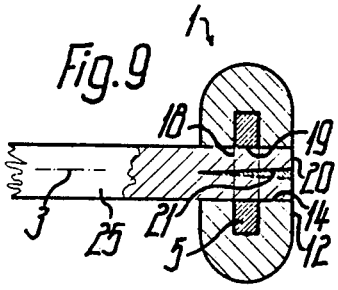
Fig.9
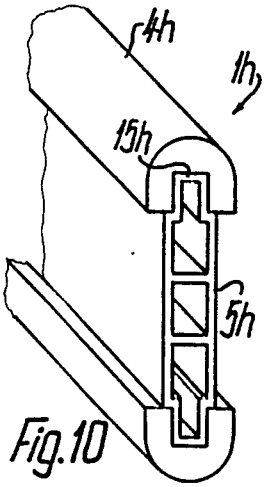
Fig.10
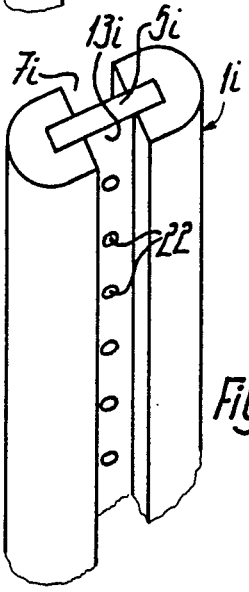
Fig.11
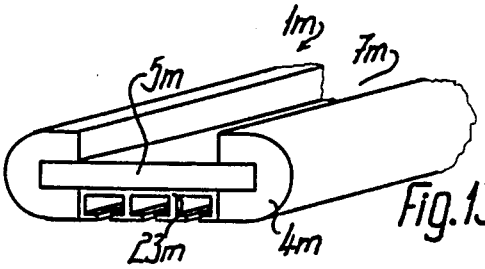
Fig.13
Fig.12
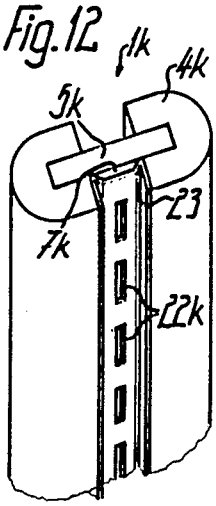

5p
7p
1p 4p
50
32
43
44
24r
33
44

2
1

7
24t
46
35
24s
53
34
45

45
7
1
47
54
36

COMPOSITE BAR SECTION

BACKGROUND OF THE INVENTION

The present invention relates to a composite or compound bar or rod section as a component for installation as a constructional member, particularly forming a structural element of articles of furniture.

Sections of this type generally have an essential supporting function and also constitute design elements of the constructional member, these requirements often being hard to reconcile with one another as a result of the requirement of limited material consumption and maximum versatility or uses.

SUMMARY OF THE INVENTION

An object of the present invention is a composite bar section, which has a simple construction and whose strength and surface characteristics can be adapted to the most varied requirements, whilst being connectable in high strength manner to other components.

According to the invention this problem is solved in the case of a composite bar section of the aforementioned type, in that the section comprises at least two parallel facing shaped bars and at least one separate connecting element inserted on their facing shaped sides and which is set back with respect to lateral faces of the shaped bars, accompanied by the formation of recesses running along the section, the recesses being constructed as reception openings for connecting elements of further components. Thus, as a function of requirements, the most varied materials can be used for the shaped bars and connecting elements and, whilst ensuring a unitary optical appearance for the same constructional members or for constructional members in a group, shaped bars with the most varied strengths can be obtained by varying the cross-sections of the shaped bars and/or the connecting elements.

A particularly high strength with slender overall cross-sections can be obtained in that the connecting element is placed in linked slots, preferably located in a common median plane, of a cross-sectionally U-shaped bar and is undetachably fixed by bonding, glueing, toothing or the like. Thus, different longitudinal sections give a particularly compact bar section, whose cross-section, for example, can correspond to that of a flat bar with rounded edges and two central longitudinal slots on the flat sides.

For further applications, it is advantageously possible for the section bar to have two or more linked slots located in a median plane and/or at an angle to one another with in each case at least one inserted connecting element or the like. Thus, the connecting elements can be juxtaposed in series and/or arranged radially with respect to one another. other.

The connecting element can be constituted by individual parts, which are directly adjacent to one another and/or positioned in a staggered manner, but in the case of high strength the section can be produced in a substantially continuous manner and is then cut to the desired size, if at least one connecting element is defined in a substantially ledgelike manner and between the shaped bars has a thickness, which is at the most slightly greater than the width of the particularly rectangularly defined linked slots. If the thickness of the, for example, flat bar-like connecting element is the same as the width of the linked slots, the connecting element can be cross-sectionally defined in uninterrupted square manner.

As a result of the construction according to the invention, it is possible for at least one shaped bar and/or one connecting element to be formed by a hollow section, particularly a hollow chamber section, so that on the one hand high strengths can be obtained for a low weight and on the other hand cavities are provided for receiving supply lines, fittings and the like.

According to a preferred embodiment, at least one section bar and/or at least part of the connecting element is made from a wooden material, such as laminated wood, solid wood, plywood, etc, the run of the grain of the section bars on the one hand and the connecting elements on the other being selected differently and consequently being adaptable to the particular requirements. It is also possible to use for the section bars and the connecting element or elements different wooden materials, eg solid wood for the section bars and laminated, plywood, etc for the connecting element which essentially has a carrying function. However, it can also be appropriate if at least one shaped or section bar and/or at least part of the connecting element is formed from an extruded part made from metal or the like, so that even higher strengths for the same cross-sections can be obtained.

As a function of the use, it is also possible, with an otherwise identical external appearance, to make the section such that the groove-like recess is cross-sectionally undercut, eg T-slot-shaped, dovetail-shaped or the like and preferably its lateral boundary surfaces are formed exclusively by the shaped bars and/or their base surface exclusively by the connecting element. Thus, it is possible to obtain rails or positively securing section slots, eg for guiding suspended doors, sliding doors, roller blind slats, drawers, etc. Both the recess defined with planar inner faces rectangularly or approximately square, as well as the undercut recess is advantageously suitable for receiving the most varied further components, eg a concealed hinge, a rear wall, a side wall, shelf bottom, shelf rail, signs, row or place numbers, tablet charts, row connecting elements, arm rests, projection plane plates, sound absorbing elements, plug strips, cable ducts, contact rails, suspension plates for tables, sealing profiles or brushes, insertable undercupboards, curtain rails, flat linen or sunshine screens, front or side shutters, etc. Both the parts inserted in linked slots and those inserted in recesses can be made from the most varied materials, eg glass, aluminium, plastic, etc and can eg have a lattice structure.

According to another proposal of the invention, the lateral faces of the recess are provided with interlocking members, particularly uniformly distributed over the length thereof, preferably in the form of abutment teeth, ie for example a sawtooth system, so that between said lateral faces it is possible to insert in braced manner a rubber-elastic support element and this can be used for the continuous vertically adjustable holding of false bottoms and the like. Instead of or in addition to this, it is appropriate to provide the bottom surface of the recess with interlocking members, particularly uniformly distributed over the length thereof and preferably at least one row of holes, at least partly directly placed in the connecting element and/or in a further rail bar inserted in the recess, eg a shelf rail.

A further particularly advantageous development of the invention is that the connecting element for receiving the end of an angularly connected component has a window-like pinning opening, particularly only extending to the lateral faces of the recess, whereof at least two facing limiting surfaces are constructed as fixing surfaces, eg as gripping surfaces for the component braced by wedging, so that said component is braced both on either side of the connecting element on the facing profile faces of the shaped bars, and on the associated facing limiting surfaces of the pinning opening and despite relatively small connection cross-sections ensures a high strength connection. According to an advantageous embodiment, eg portions of the section according to the invention form the standing supports of a four-legged chair, whereof one front and one rear frame with their ends laterally projecting over a frame member incorporating the same, are connected as a further component to the recesses of the associated standing support sections. These frames, which are appropriately also constructed as flat bars, have a thickness, which is precisely the same as the width of the recesses of the standing supports, ie a thickness precisely the same as the spacing between the shaped bars of the particular standing support.

As a result of the described construction, the ends of the bar section according to the invention also form reception plugs for the positive arrangement of corresponding end pieces, which can be constructed in accordance with the requirements for the most varied technical effects. For example, one end of the section can be provided with a further component in the form of an end piece, which has plugs positively engaging between the section bars and in particular an end plate, which is congruent to the end faces of the section bars and covers the recesses at one end, so that a smooth-surface termination is obtained of the section end, eg only subject to a separating cut. This or a similarly constructed terminal component can eg have at least one plug for the clip-like end-connecting engagement in recesses of adjacent sections, so that section portions which are parallel to one another or correspondingly spaced can be combined by one or two such components in cliplike manner to provide a dimensionally stable constructional element. The component provided with the plug or plugs can be constructed in such a way that it can be arranged in non-rotary, interchangeable, engaging in linearly connected sections and in many other ways. For example, this component can be constructed with a microbush, an illuminant for emergency lighting purposes, or as a reading lamp. It can also be constructed for hanging in a tablet chart, tray, writing support, music stand, invalid chair, knee rest, foot rest, cam, card rack, clothes stand, newspaper stand, glass plate and the like.

A particularly advantageous further development of the invention is that at least one further component has a fastening element for the centred or guided engagement between the section ends in at least one recess of at least one section. Preferably two fastening elements are at an angle to one another and/or are pivotably mounted on one another about an axis roughly at right angles to the bottom surfaces of the recesses of the sections to be connected. Thus, all the necessary parts or furniture accessories, such as arm rests, tablet charts, etc can be fixed along the particular section at any random or appropriate point in the recess. If there are two fastening elements at an angle to one another, then the further component is suitable for connecting together two bar sections at an intersection and in the case of a pivotable mounting of the two fastening elements on one another, the two bar sections can assume any random angular position relative to one another.

For example when used for a row of chairs, the further component can be advantageously used as a designation carrier, eg for the seat number or the row number of chairs, the end plate being used for the seat number and the outer surface of a plug for the row number.

Furthermore, according to the invention, at least one further component can be constructed as a support, particularly as a base screw angle, base slider, skid, runner, vertically adjustable level compensating foot or the like, so that there is a careful termination of the lower end of the bar section.

The section according to the invention is advantageously suitable as a variable constructional element because, the connecting element forming an intermediate part, eg in the case of identical section bars, can be dimensioned in the most varied manners. The two recesses on the two sides of the section are suitable for solving many problems of a technical nature occurring in furniture and internal fitting, eg for centring, acting as a stop for a second part, for colouring systems, etc. The connecting element can eg be varnished or painted separately from the section bars, so that only then are the section bars and connecting element assembled to provide the composite section, which leads to simple production if the base surface of the recess has a different colouring to the remaining surfaces of the section. The connecting element can also be formed in sandwich-like manner from layers of different materials or two spaced eg ledge-like individual elements, which in each section bar are placed in separate linked slots and define between them a cavity, in which is eg integrated a cable for electrical power connections. The section is therefore particularly suitable for producing tables, folding tables, chairs, arm chairs, arm chair groups, cupboards, display cabinets, shelves, desks, typewriter tables, lecterns, beds, couchettes, auditorium chairs, containers, signs and many other things, both in shop and exhibition construction.

Features of preferred further developments of the invention can be gathered from the description and drawings, whereby these features and those of subclaims can be realized individually or in the form of subcombinations in an embodiment of the invention.

BRIEF DESCRIPTION OF THE DRAWINGS

The invention is described in greater detail hereinafter relative to non-limitative embodiments and the attached drawings, wherein show:

FIG. 9 the connection of a component located at an angle in the cross-section through the section.

FIGS. 10 to 13 further embodiments of sections in perspective views.

FIG. 14 two sections combined in a clip-like component in a perspective representation.

DETAILED DESCRIPTION OF THE PREFERRED EMBODIMENTS

Figure 1:
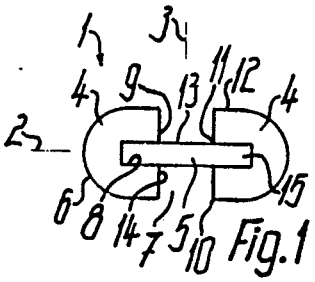
FIG. 1*a* composite bar section according to the invention in end view.

As can be gathered from FIG 1, a composite bar section according to the invention is provided with linearly continuous, identical, approximately H-shaped cross-sections, its cross-sectional extension parallel to the median plane 2 passing through the H-cross bar generally being twice as large as parallel to the median plane 3 at right angles thereto. On the longitudinal faces at right angles to median plane 3, the section is rounded in pitch circle-like manner and in the represented embodiment in semicircular manner, whilst the remaining edges, particularly the boundary edges of two groove-like recesses are sharp. The section is symmetrical to median plane 2 and symmetrical to median plane 3, ie preferably axially symmetrical to a longitudinal axis located in both median planes.

Section 1 essentially comprises three separate parts, which are undetachably joined together by suitable means, such as eg glueing following the completion thereof, and/or optionally also following the varnishing thereof. Two such parts are identically constructed and form two section bars 4 facing one another on either side of median plane 3 and whose cross-sectional extension parallel to the median plane 2 is approximately the same as or slightly smaller than its cross-sectional extension parallel to median plane 3. These section bars 4 form the pitch circle-like, rounded longitudinal edge surfaces 6 of the section. A connecting element 5 in the form of a cross-sectionally elongated, rectangular flat bar is inserted between the section bars 4 symmetrically to the median plane 2. Connecting element 5, which preferably passes in uninterrupted manner over the length of the section bars 4 forms a spacer between the section bars 4, so that between these, the two cross-sectionally, identical, slot-like recesses 7, positioned on either side of the connecting element 5 extend in uninterrupted manner over the entire length of the section.

The width of these recesses 7 defined in the manner of rectangular slots is appropriately half greater than the depth thereof, which is in turn greater than the thickness of connecting element 5 in the vicinity of recesses 7. For receiving connecting element 5, each section bar is provided on its inner face 9, which faces the other section bar 4, which is flat and parallel to the median plane 3 with a linked slot 8 symmetrical to median plane 2, which is completely filled by the engaging portion of the connecting element 5 and in the represented embodiment is defined in the manner of a rectangular slot, whose depth is greater than its width. Thus, connecting element 5 engages in each section bar 4 to a depth corresponding roughly to half its cross-sectional extension parallel to median plane 2 and is approximately one third smaller than the width of recesses 7. The lateral faces of the composite slots 8 are parallel to the median plane 2, whilst the base surfaces thereof are at right angles thereto. The transition longitudinal edges 10 between inner faces 9 and/or the lateral faces of recesses 7 and the outer flank faces 12 of section bars 4 are rectangularly sharp-edged in cross-section, like the inner, reentrant corner edges of recesses 7, which are formed by the transition between the inner faces 9 and the exposed flank faces of the connecting element 5, which form the base faces 13 of recesses 7. The inner faces 9 of section bars 4 form the lateral faces 14 of recesses 7. Connected to the longitudinal edges 1O, the flank faces 12 are flat and then they pass into the rounded longitudinal edge faces 6. The centre axis of the longitudinal edge faces 6 is consequently roughly in the base face of the associated linked slot 8. The side portions 15 of connecting element 5, which engage in the linked slots 8, in the embodiment according to FIG. 1 have the same thickness as the remaining connecting element 5, ie the same as its portion between the section bars 4, so that the associated outer faces of connecting element 5 pass uninterruptedly over its width and optionally in flat manner.

In FIGS. 2 to 14, the same reference numerals as in FIG. 1 are used for corresponding parts, but they are followed by different small letters.

Figure 2:
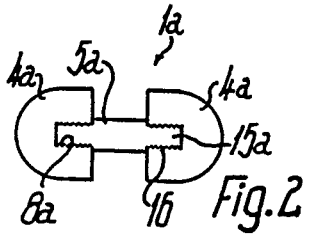
FIGS. 2 to 8 further embodiments of sections in representations corresponding to FIG. 1.

Section 1*a* according to FIG. 2 has substantially identical section bars 4*a* to the section according to FIG. 1, but between said section bars 4*a* the portion of connecting element 5*a* is thicker than in FIG. 1. The ledge portions 15*a* of connecting element 5*a* engaging in the linked slots have the same thickness as in FIG. 1, ie their thickness is slightly reduced compared with the central portion. In addition their outer faces belonging to the lateral faces of linked slots 8*a* are provided with an eg barb or sawtooth longitudinal tooth system 16, so that they engage under pretension in claw-like manner in the lateral faces of linked slots 8*a* and consequently a stable connection is obtained.

Figure 3:
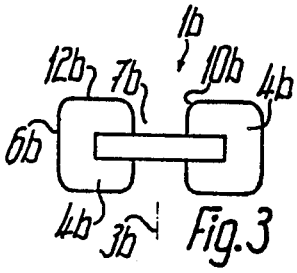

Section or shaped bars 4*b* of section 1*b* according to FIG. 3 are crosssectionally rectangular or approximately square, all the longitudinal edges of the section bars being rounded in approximately quadrant-like manner, so that the longitudinal edges 10*b* associated with recesses 7*b* are also rounded. The remote longitudinal edge faces 6*b* of section bars 4*b* are formed by planar surfaces, which are parallel to the median plane 3*b*.

Figure 4:
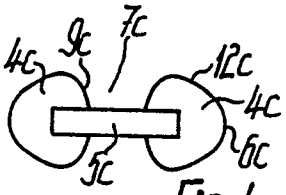

As shown in FIG. 4, the section bars 4*c* can be cross-sectionally constructed in such a way that the recesses 7*c* are widened in approximately acute-angled manner to the open sides thereof, because the inner faces 9*c* on each side of the connecting element 5*c* converge towards the latter. The inner faces 9*c* pass via rounded portions into outer faces 12*c*, 6*c* of the section bars 4*c*, which converge in rounded triangular manner to the remote sides thereof.

Compared therewith the cross-sectionally acute-angled equal-sided or equilateral section bars 4*d* have planar outer faces, which are formed by the inner faces 9*d* and the flank faces 12*d*, said outer faces passing into one another via rounded longitudinal edges 6*d*, 1O*d*.

Figure 6:
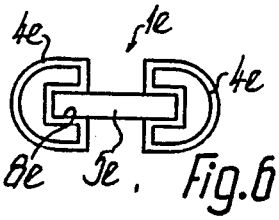
Figure 5:
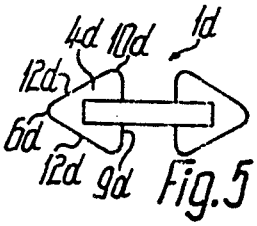

According to FIG. 6, the section bars 4*e* can also be formed by hollow sections, which appropriately have a constant wall thickness over their cross-section and a continuously closed wall.

Figure 7:
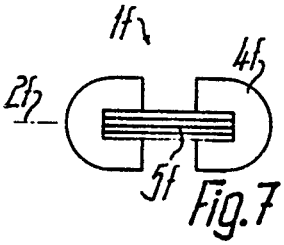
Figure 15:
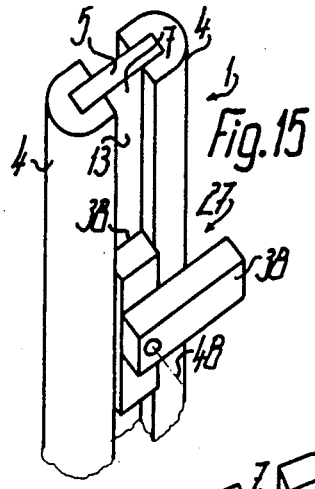
FIGS. 15 to 20 embodiments of further components for insertion between section ends.

As shown in FIG. 7, the connecting element 5*f* can also be formed from several parts, whose jointing planes are appropriately roughly parallel to the median plane 2*f*. These parts can be formed by layers of plywood or laminated wood, laminates in sandwich structure, or the like. It is also conceivable for gaps to be left between at least two parts of the connecting element 5*f* and these pass over the length of the latter and consequently form continuous cavities over its width and length.

Figure 8:
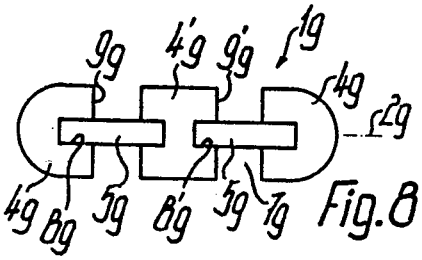

FIG. 8 shows a section 1g, which has three section bars 4g, 4'g and two connecting elements 5g, which cross-sectionally are arranged in succession parallel to the median plane 2g. The two outer section bars 4g correspond to the aforementioned section bars and are provided on their inner faces 9g with in each case one linked slot 8g, whilst the section bar 4'g has a cross-sectional shape diverging from the section bars 4g and in the represented embodiment has a rectangular cross-section and is provided on its remote longitudinal faces 9'g facing the inner faces 9g with in each case one linked slot 8'g. Linked slots 8'g have a reduced depth compared with linked slots 8g, but the cross-sectional extension of section bars 4'g parallel to the median plane 2g is approximately the same as that of the section bars 4g. As a result of this construction, section 1g is provided on each side with two juxtaposed, cross-sectionally identical recesses 7g.

FIG. 9 shows the fixing of a further component 25 to a section according to the invention and in the present embodiment to section 1 according to FIG. 1. The further component 25 is eg a cross-sectionally flat, rectangular frame made from wood or the like, whose thickness precisely corresponds to the width of recesses 7. An opening 18 is provided in connecting element 5 for the insertion of component 25 and its extension in the longitudinal direction of section 1 is the same as the cross-section height of the component 25 and its lateral boundary faces 19 are located in the plane of the in each case associated equiplanar lateral faces 14 of recesses 7, so that there are uninterrupted lateral fixing faces over the thickness of section 1 and/or between the flank faces 12 extending, with interruptions, through connecting element 5. Component 25 is inserted so far from one side of section 1 until its end face 20 terminates flush with the associated flank faces 12 of section 1. A flat, acute-angled key 21 is then driven into a corresponding key seat of component 25 from end face 20 and it extends at least approximately over the thickness of section 1 and is located in median plane 3. Key 21 uniformly braces component 25 with respect to the lateral faces 14 of both recesses 7 and with respect to the boundary faces 19 of opening 18 and consequently with respect to the connecting element 5, ie uninterruptedly over the entire thickness of section 1.

Section 1h according to FIG. 10 has as the connecting element 5h a hollow chamber section in the form eg of an extruded section, which is subdivided over the width of connecting element 5 into a plurality of rectangularly defined chambers, which are completely closed to the outside, except at the ends, the subdivision being provided by partitions. The reciprocally completely closed chambers between the ends of connecting element 5h can be used for receiving supply lines, eg electrical lines and the like.

On the base faces 13i of both recesses 7i, section 1i according to FIG. 11 has interlocking members uniformly distributed over its length in the form of a row of holes 22, which is located in the centre of the width of recesses 7i and is formed by holes passing through connecting element 5i. Thus, supports for shelf bottoms or the like can be inserted in vertically adjustable manner in the row of holes 22. In the case of section 1k according to FIG. 12, these interlocking members are not provided directly in connecting element 5k and are instead formed by a separate rail bar 23, which is inserted in the associated recess 7k. In the manner of so-called shelf rail, rail bar 23 has superimposed rows of elongated, rectangular openings for the random insertion of support brackets, on which shelf edges can be placed. The cross-bar of the cross-sectionally U-shaped rail bar 23, in order that the support brackets with their hook-like hang-in elements have space behind the rail bar 23, is spaced from the connecting element 5k, whilst the section leg of rail bar 23 engages by its entire surface on the lateral faces of recess 7k and extends to the connecting element 5k.

In the case of section 1m according to FIG. 13, the additional rail bar 23m is constituted by a curtain rail, which substantially completely fills the associated recess 7m. In accordance with the width of rail bar 23m, the section bars 4m are further apart than in most of the previously described sections, the free central portion of the connecting element 5 being correspondingly wider.

FIG. 14 shows two identical sections 1n, with their flat sides engaging with the one another, whose recesses 7n are undercut in the manner of dovetailed grooves. For producing this recess shape, the facing boundary surfaces 9n of section bars 4n are made V-shaped in obtuse angle form symmetrically to the median plane 2n. Thus, further components, fixing members and the like having guidance members with cross-sections corresponding to recesses 7n can be inserted in the latter in the longitudinal direction of the sections, so that they are then positively held in all directions. FIG. 14 also shows a further embodiment for a further component 26, which is intended for the terminal arrangement onto sections 1n placed against one another according to FIG 14, so that as a result of this component the two sections 1n are fixed to one another in clip-like manner. For this purpose, the further component 26 has parallel plugs as connecting members 37 on an end plate 24 and the cross-sectional shape thereof is adapted to that of recesses 7n. Two outer plugs 37 are arranged in spaced manner in such a way that when the sections 1n are placed against one another, they fit in substantially clearance-free manner in the remote recesses 7n, whilst a central plug is constructed in double-dovetailed manner, so that it substantially completely fills in clearance-free manner the two facing recesses 7n of both sections 1n, whose open sides pass into one another and over the entire length thereof. This leads to a multiple positive connection of component 26 to both sections 1n, so that the latter can be reliably fixed to one another with a relatively high strength. The end plate 24 is so constructed and arranged that with component 26 inserted, it congruently covers both end faces of the sections 1n and closes the ends of recesses 7n.

FIGS. 15 to 19 show further components 27 to 31, which have connecting members 38 to 42 for guided engagement in a recess 7 of a section 1 according to FIG. 1 located between the section ends. The connecting members 38 to 42 have the substantially common feature that they engage in a virtually clearance-free manner in recess 7 and are formed, for example, by a correspondingly dimensioned rectangular bar piece which, in the manner of a fixing member, can be secured by screws relative to connecting element 5. The embodiment of FIG. 15 relates to a connecting piece for transversely and longitudinally positioned sections 1, whereof only one is shown and which can be fixed with respect to said connecting piece at a random point of the longitudinal extension thereof. For this purpose, two connecting members are pivotably arranged about an axis 48 at right angles to the base faces 13 of the two sections to be interconnected, said axis 48 being located in the centre of the width of the base faces. Thus, the sections 1 interconnected via component 27 can be set so as to pivot with respect to one another at an angle about axis 48. The connecting members 38 only project slightly over the flanks of section bars 4, so that the two interconnected sections 1 merely have the spacing required as a clearance of motion. It is also conceivable to place the two connecting members 38 at the desired angle in a fixed or fixable manner, so that the two interconnected sections 1 assume a precisely defined angle relative to one another.

Figure 16:
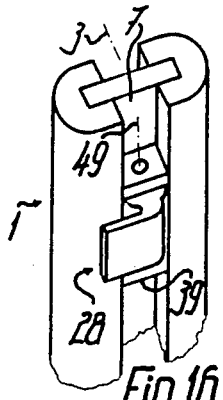

Connecting member 39 of component 28 according to FIG. 16 forms part of a pin hinge, whose hinge axis 49 is parallel to section 1 in the median plane 3 and within the associated recess 7, so that a concealed hinge is obtained, whose other hinge part projects from section 1 for fixing the component, such as a door or the like which is to be pivotably mounted.

Figure 17:
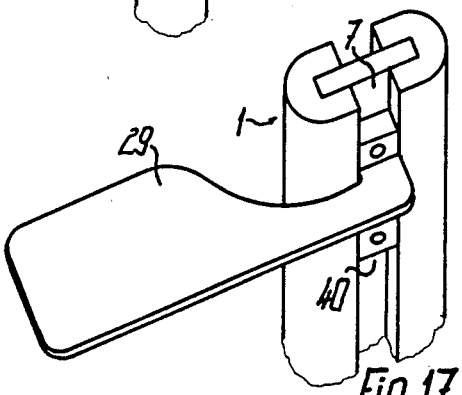
Figure 18:
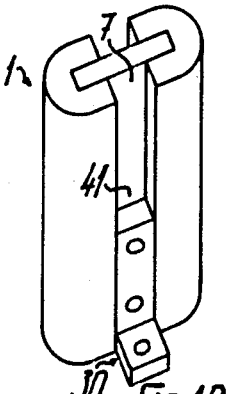

Component 29 according to FIG. 17 is eg a tablet chart for a chair, which is dimensionally rigidly connected to connecting member 40, which is constructed similar to connecting member 38.

Component 30 is constructed as a base fixing angle, whose bottom angle leg projecting outwards over the section is located with its bottom surface in the plane of the lower end face of section 1 and whose connecting member 41 formed by the other angle leg is completely arranged in the associated recess 7. This component 30 can eg be used as an anti-panic device for rows of chairs, in which relatively large intervals, individual chairs are fixed by pins to the floor in such a way that they cannot slide, but in an emergency the security means can easily be detached. The pin passes through the horizontal angle leg and engages in a corresponding counter-opening in the floor, so that it can be disengaged by merely raising the chair.

Component 31 according to FIG. 9 is an arm rest, which is formed by a long leg of the angular component 31, whose other leg forms the associated connecting member 42.

Figures 20, 22, 23, 24, 25:
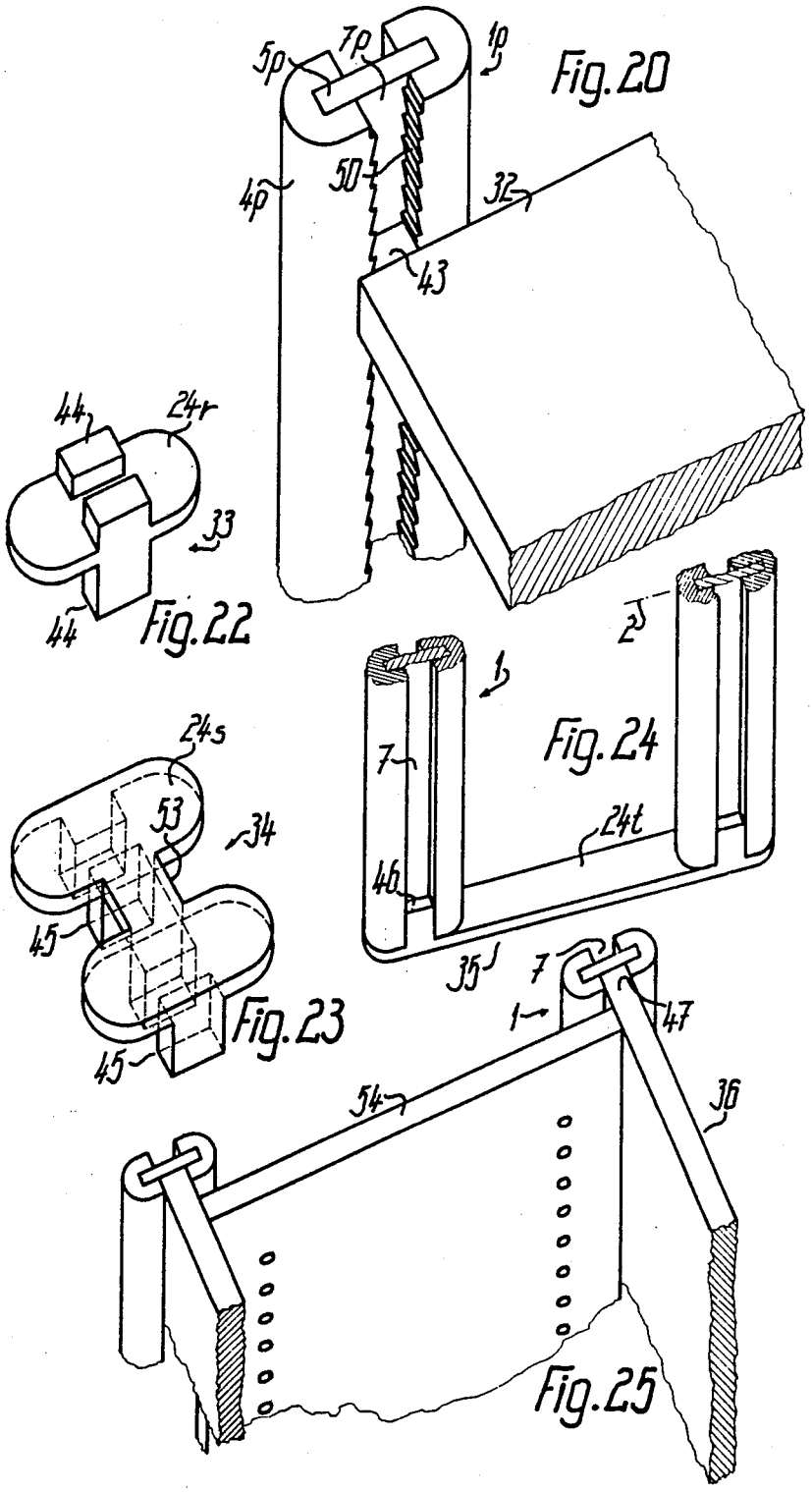
FIG. 25 an article of furniture using sections according to the invention.

Section 1*p* according to FIG. 20 is provided on the lateral faces of one or both recesses 7*p* with abutment teeth 50, which pass over the entire length of section 1*p*. With recess 7*p* is eg associated a rubber-elastic connecting member 43, which is insertable in the recess with pretension in such a way that it is pressed in claw-like securing manner in abutment teeth 50 and is suitable for supporting a further component, eg in the form of a table plate 32.

Figure 21:
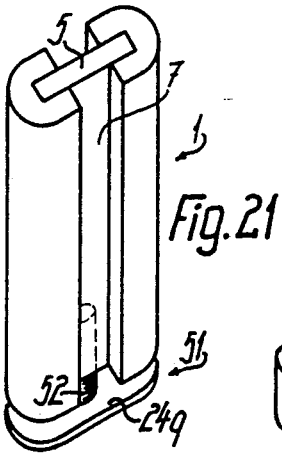
FIGS. 21 to 24 embodiments for components to be fitted to the ends of sections.
Figure 19:
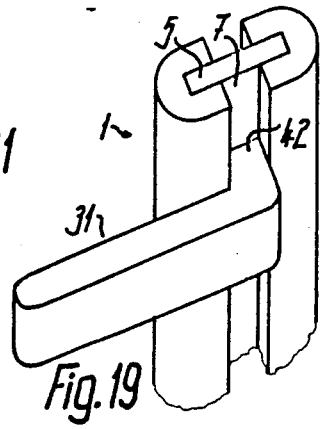

FIG. 21 shows an end piece 51, eg for a section 1 which, instead of being secured by engaging in recesses 7, engages from the associated end face directly in the connecting element 5. For this purpose, end piece 51 is provided on an end plate 24*q* with a rectangularly projecting pin 52, in the form of a dowel or screw pin, which engages in a corresponding opening in connecting element 5.

FIG. 22 shows a further component 33 in the form of an end piece, which has an end plate 24*r* and on either side connecting members 44 projecting in the form of plugs over the same in such a way that two sections 1 can be interconnected in their longitudinal direction and the end plate 24*r* engages on the facing end faces of both sections in a covering manner or as a flat intermediate member. The connecting members 44 in the represented embodiment are adapted to a section 1 according to FIG. 1 and are aligned on either side of end plate 24*r*, the connecting members 44 on either side of the end plate 24*r* having the same or different lengths.

FIG. 23 shows a further component 34, which is provided in much the same way as component 26 of FIG. 14 for joining two parallel, juxtaposed sections. The connecting members 45 in the form of plugs adapted to the recesses 7 of section 1 are spaced in pairs in such a way, that the two sections to be interconnected in clip-like manner by component 34 do not directly engage against one another and instead have a predetermined reciprocal spacing. For this purpose, the two end plates 24*s* are kept spaced by means of a connecting web 43.

Whilst components 26 and 34 are constructed according to FIGS. 14 and 23, so that they interconnect the associated sections in such a way that they are adjacent in the median plane 3, component 35 is so constructed that the sections 1 according to FIG. 24 connected by it are adjacent to one another in the direction of median plane 2. Component 35 engages with plug-like connecting members 46 from the lower ends of sections 1 into the recesses 7 thereof. Sections 1 can eg be the standing supports or legs of a chair, table or the like and are arranged in correspondingly spaced manner. The end plate 24*t* of component 35 passing over both sections eg forms a skid for the associated furniture.

The further component 36 of FIG. 25 is eg the side walls of an insertable undercupboard, whose associated edge zones form the connecting members 47 which fit into recesses 7 of sections 1. Immediately adjacent to sections 1, the side walls are interconnected by means of a crossplate 54.

Figure 26:
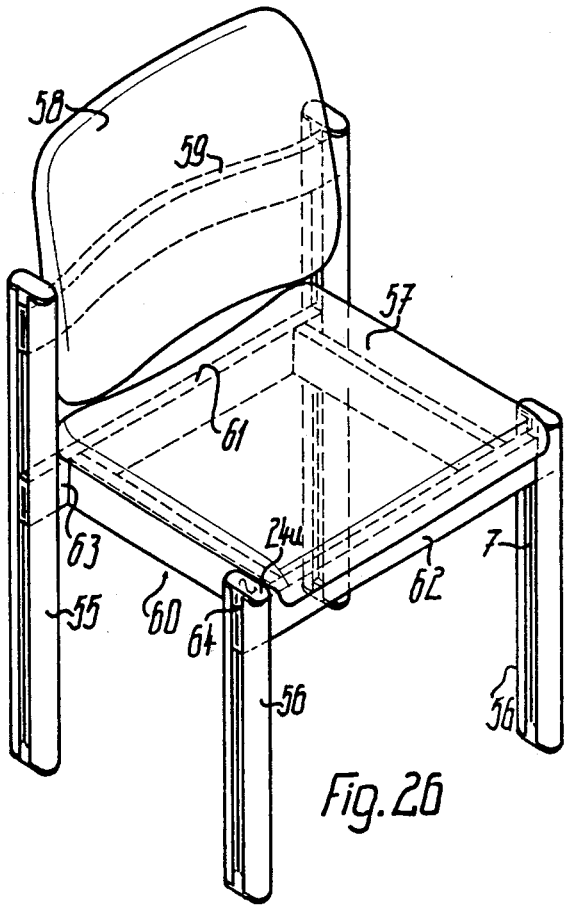
FIG. 26 a perspective view of a chair constructed with sections according to the invention.

FIG. 26 shows a chair 17 constructed from sections according to the invention and whereof four standing supports 55, 56 are formed by portions of section 1 according to FIG. 1. The rear standing supports 55 are higher than the front standing supports 56 and above the seat part carry a back rest 58 on a curved cross-frame 59. Below seat part 57 is provided a rectangular frame member 60 made from four frame legs, whose rear and front frames 61, 62 project laterally with their ends over the two other frames. These ends 63, as well as the aligned ends of cross-frame 59 are fixed in the two associated standing supports 55, 56 in accordance with the explanation given relative to FIG. 9, ie they are passed through cutouts of the connecting member and are wedged, accompanied by glueing. The upper and lower ends of the standing supports 56 are covered with end pieces, whereof at least one can be provided as a designation carrier in such a way that its end plate 24*u* or the outer face of its outer plug 64 is provided with an eg impressed numbering or legend.

Figure 27:
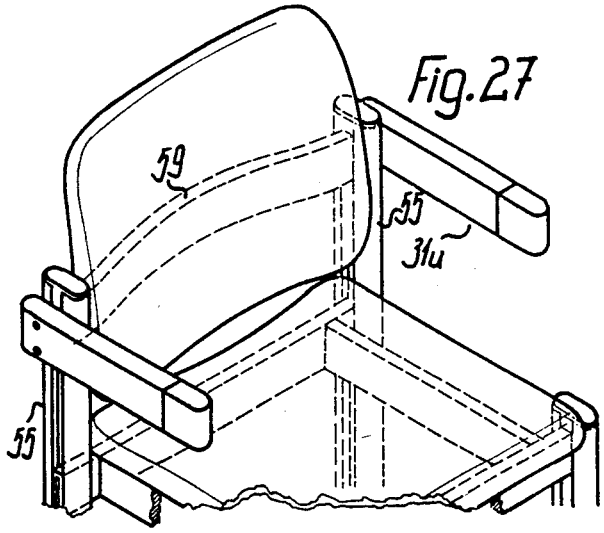
FIG. 27 a modification of the chair of FIG. 26.

The chair according to FIG. 27 differs from that according to FIG. 26 essentially only in that it is provided with arm rests 31*u*. The latter are fixed by appropriate fixing members into the ends of the crossframe 59, braced against the associated outer faces of the rear standing supports 55 and are optionally secured to adjacent chairs in such a way that there is only a common arm rest between the adjacent chairs.

Figure 28:
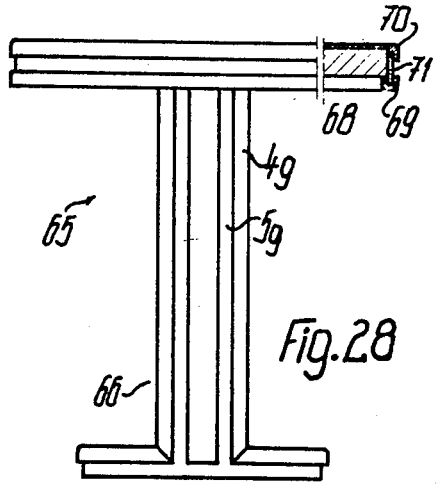
FIG. 28 a table constructed from sections according to the invention.

Table 65 according to FIG. 28 is eg provided with standing supports 66, which are formed from sections according to FIG. 8, the two outer section bars 4*g* passing in the lower region into horizontal portions directed away from one another and carry a part 67 of connecting member 5 projecting over their bottom surfaces and which forms the standing surface of the table, eg in the form of a plastic slide. The table plate 68 is provided with a skirting, which has on the bottom surface of table plate 68 a U-shaped section bar 69, on the top surface a cross-sectionally angular section bar 70 and a flat, ledge-like connecting member 71 connecting the same, which is externally overlapped by the upright angle leg of the upper section bar 70, so that once again there is a groove-like recess with set back base surface.

Figure 30:
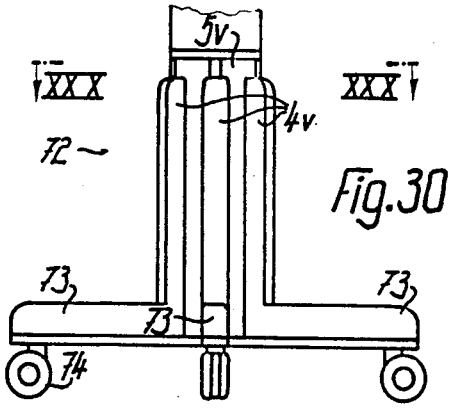
FIG. 30 a view of the pedestal in FIG. 29.
Figure 29:
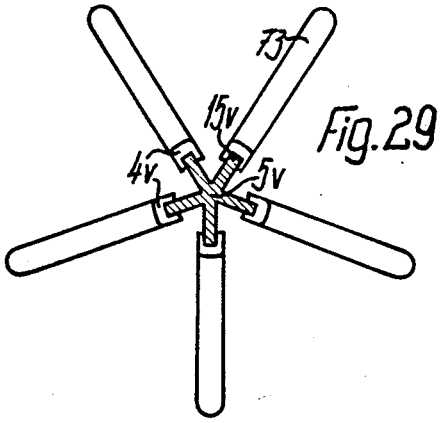
FIG. 29 a single-column pedestal, eg for a swivel chair in section along line XXX—XXX of FIG. 30.

As shown in FIG. 29, the connecting member 5*v* can also be cross-sectionally radial and carries on each ledge portion 15*v* a section bar 4*v* and in the represented embodiment five uniformly distributed section bars 4*v*. The lower ends of section bars 4*v* pass into stand arms 73 projecting radially from connecting member 5*v* and in the vicinity of their free ends, said stand arms are provided on the bottom surface with a runner 74 in each case. According to FIG. 30, this arrangement is provided for forming a single-column swivel chair pedestal 72, whose column is located in the central axis of connecting member 5*v*.

Figure 31:
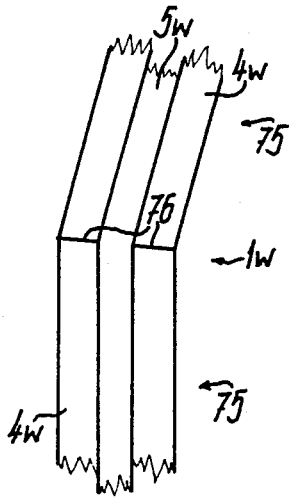
FIG. 31 a detail of a further composite bar section.

As shown in FIG. 31, section 1*w* according to the invention can be subdivided in a simple manner into portions 75 which are at an angle to one another. The connecting member 5*w* can be constructed in one piece by corresponding cutting or bending, so that very high strengths are also obtained with such an embodiment. The portions of section bars 4*w* which are at an angle to one another consequently abut at 76 in mitre cut manner and by their abutting end faces can be directly interconnected eg by glueing.

What is claimed is:

1. A composite rod profile forming a structural member for assembly as a part of room appointments, the rod profile comprising, in cross-section, an assembly of at least three separate profile bars joined along their length, at least one of the profile bars being made from a wooden material, the three separate profile bars including two oppositely arranged separate profile bars of substantially equal cross-section, having side faces and front section sides, the front section sides facing one another and the side faces being directed outwardly, the front section sides being spaced at a distance from one another, at least a third separate profile bar inserted into the front facing section sides of said two oppositely arranged separate profile bars, the third separate profile bar thereby forming a connecting bar between the two oppositely arranged separate profile bars, said connecting bar being set back with respect to the side faces of said two oppositely arranged separate profile bars, thereby defining with said oppositely arranged separate profile bars at least one recess forming a reception opening for receiving attachment elements.

2. A rod according to claim 1, wherein the connecting bar is inserted in aligned linkage slots of the oppositely arranged profile bars, the connecting bar linking the oppositely arranged profile bars and being undetachably fixed therein.

3. A rod according to claim 1, wherein the connecting bar is inserted in linkage slots defined in each of the oppositely arranged profile bars, the linkage slots being located in a common median plane and the connecting bar being undetachably fixed in said linkage slots of the oppositely arranged profile bars.

4. A rod according to claim 1, wherein the oppositely arranged profile bars have a U-shaped cross-section and the connecting bar is inserted in linkage slots defined by said U-shaped cross-section and is undetachably fixed in said linkage slots.

5. A rod according to claim 1, wherein the connecting bar is fixed in the oppositely arranged profile bar by bonding.

6. A rod according to claim 1, wherein the connection bar is fixed to the oppositely arranged profile bars by complementary teeth in the connecting bar and oppositely arranged profile bars, respectively.

7. A rod according to claim 1, wherein at least one of the oppositely arranged profile bars has at least two linkage slots located in a median plane with at least one connecting bar being inserted in each of the slots.

8. A rod according to claim 1, wherein at least one of the oppositely arranged profile bars has at least two linkage slots displaced at an angle to one another, with in each case at least one connecting element being inserted in each of the slots.

9. A rod according to claim 1, wherein at least one connecting bar as a substantially ledge-like stepped cross section.

10. A rod according to claim 1, wherein at least one connecting bar arranged between the oppositely arranged profile bars has a thickness slightly larger than a width of the linkage slots.

11. A rod according to claim 1, wherein the linkage slots are rectangular in cross-section.

12. A rod according to claim 1, wherein at least one of the oppositely arranged profile bars is hollow in cross-section.

13. A rod according to claim 1, wherein at least one of the oppositely arranged profile bars defines a plurality of hollow chambers.

14. A rod according to claim 1, wherein at least one of the oppositely arranged profile bars is at least partly formed by an extruded metal section.

15. A rod according to claim 1, wherein the recess forming the reception opening is an undercut groove.

16. A rod according to claim 1, wherein the recess is bounded by lateral boundary faces defined exclusively by the oppositely arranged profile bars, the recess having a base face defined exclusively by the connecting bar.

17. A rod according to claim 1, wherein lateral boundary faces of the recess are provided with interlocking members over a length of the boundary faces.

18. A rod according to claim 17, wherein the interlocking members are abutment teeth.

19. A rod according to claim 1, wherein a base face of the recess is provided with interlocking members distributed over a length of the base face, the interlocking members being at least partly directly located in the connecting bars.

20. A rod according to claim 1, wherein a base face of the recess is provided with interlocking members distributed over a length of the base face and the base face being at least partly defined by a further rail bar inserted in the recess.

21. A rod according to claims 19 or 20, wherein the interlocking members are formed by a row of holes.

22. A rod according to claim 1, wherein the connecting bar has a window-like opening for receiving an end of an angularly oriented connecting component, the window-like opening being defined by facing boundary faces, at least two of the facing boundary faces of said opening being constructed as fixing surfaces for the attachment elements.

23. A rod according to claim 22, wherein the window-like opening only extends up to lateral boundary faces of the recess.

24. A rod according to claim 22, wherein the facing boundary faces are constructed as gripping surfaces for the attachment elements and are adapted to be braced by wedging.

25. A rod according to claim 1, further comprising an end piece, the end piece having connecting members including plugs positively engagable in ends of the oppositely arranged profile bars, the plugs being attached to an end plate which is congruent to end faces of the oppositely arranged profile bars and connecting bar, and terminally closes the recesses.

26. A rod according to claim 1, further comprising at least one further component defining a connecting member with at least one plug for positive engagement in an end of the rod, the plug extending into the recess, the connecting member having an additional plug positively engagable in an adjacent rod, whereby the rod is attachable adjacent similar rods.

27. A rod according to claim 1, further comprising at least one further component operable to afix an end of the rod to an intermediate area of another said rod, the further component engaging between an end of the rod and the recess of the another said rod.

28. A rod according to claim 27, wherein the rod and the another said rod are connectable by said at least one further component at an angle to one another and are pivotable on said at least one further component about an angle approximately at right angles to a base face of the recess of the rod and the another said rod.

29. A rod according to claim 1, further comprising a least one designation carrier positively fixable in the recess and in an end of the bar.

30. A rod according to claim 1, further comprising a standing member attachable to an end of the rod, the standing member being operable to support the rod.

31. A rod according to claim 1, further comprising a cable for electrical connections, integrated into the connecting bar.

32. A rod according to claim 1, further comprising means carried on the rod defining an element of furniture.

33. A rod according to claim 1, wherein the connecting bar is fixed to the oppositely arranged profile bars by glueing.

34. A room appointment comprising:

a composite rod profile having, in cross-section, an assembly, of at least three separate profile bars joined along their length, at least one of the profile bars being made from a wooden material, the three separate profile bars including two oppositely arranged separate profile bars of substantially equal cross-section, having side faces and front section sides, the front section sides facing one another and the side faces being directed outwardly, the front section sides being spaced at a distance from one another, at least a third separate profile bar inserted into the front facing section sides of said two oppositely arranged separate profile bars, the third separate profile bar thereby forming a connecting bar between the two oppositely arranged separate profile bars, said connecting bar being set back with respect to the side faces of said two oppositely arranged separate profile bars, thereby defining with said oppositely arranged separate profile bars at least one recess forming a reception opening for receiving attachment elements and wherein, the room appointment is a four-legged chair having a front frame and a rear frame attachable to a seat frame, each of the front frame and rear frame defined by said oppositely arranged profile bars and said connecting bar, and further comprising connecting elements adapted to fix the seat frame to said front frame and rear frame.

* * * * *

UNITED STATES PATENT AND TRADEMARK OFFICE

CERTIFICATE OF CORRECTION

PATENT NO. : 4,676,469

DATED : June 30, 1987

INVENTOR(S) : Rotermund et al

It is certified that error appears in the above-identified patent and that said Letters Patent is hereby corrected as shown below:

Column 1, line 57, delete "other."

Signed and Sealed this

Twelfth Day of July, 1988

*Attest:*

DONALD J. QUIGG

*Attesting Officer*

*Commissioner of Patents and Trademarks*